US007918052B2

(12) United States Patent
Amlang et al.

(10) Patent No.: US 7,918,052 B2
(45) Date of Patent: Apr. 5, 2011

(54) DRYWALL CONSTRUCTION FOR SUPPORTING AN INSTALLATION ELEMENT AND METHOD FOR FASTENING THE INSTALLATION ELEMENT

(75) Inventors: Pierre Amlang, Bottrop (DE); Heinrich Amlang, Oberhausen (DE)

(73) Assignee: Trel Systems, A.G., Herne (DE)

( * ) Notice: Subject to any disclaimer, the term of this patent is extended or adjusted under 35 U.S.C. 154(b) by 744 days.

(21) Appl. No.: 11/869,050

(22) Filed: Oct. 9, 2007

(65) Prior Publication Data

US 2008/0086956 A1 Apr. 17, 2008

(30) Foreign Application Priority Data

Oct. 9, 2006 (DE) ..... 20 2006 015 404 U
Oct. 28, 2006 (DE) ..... 20 2006 016 532 U
Feb. 13, 2007 (EP) ..... 07102230

(51) Int. Cl.
*E04F 19/00* (2006.01)

(52) U.S. Cl. ..... 52/36.4; 52/36.6

(58) Field of Classification Search ..... 52/36.4, 52/36.5, 36.6; 211/94.01; 248/297.21
See application file for complete search history.

(56) References Cited

U.S. PATENT DOCUMENTS 4,560,130 A * 12/1985 Schwartz ..... 248/297.21
5,309,686 A * 5/1994 Underwood et al. ..... 52/29
6,926,160 B2 * 8/2005 Perkins et al. ..... 211/94.01
7,147,115 B2 * 12/2006 Perkins et al. ..... 211/94.01

* cited by examiner

*Primary Examiner* — Basil Katcheves
(74) *Attorney, Agent, or Firm* — Van Dyke, Gardner, Linn & Burkhart, LLP

(57) ABSTRACT

A drywall construction and method including an installation element, such as shelving, a cupboard shell, or the like, for the keeping of objects including a frame construction with vertical upright profiles having a C-shaped cross section with legs, wherein the installation element is fastened to the upright profiles. The installation element may have, on at least part of its outer surfaces, a first groove and a second groove parallel to the first groove and spaced away from it, and in a fastening condition, the legs of the upright profiles are inserted into the first groove and the second groove.

14 Claims, 6 Drawing Sheets

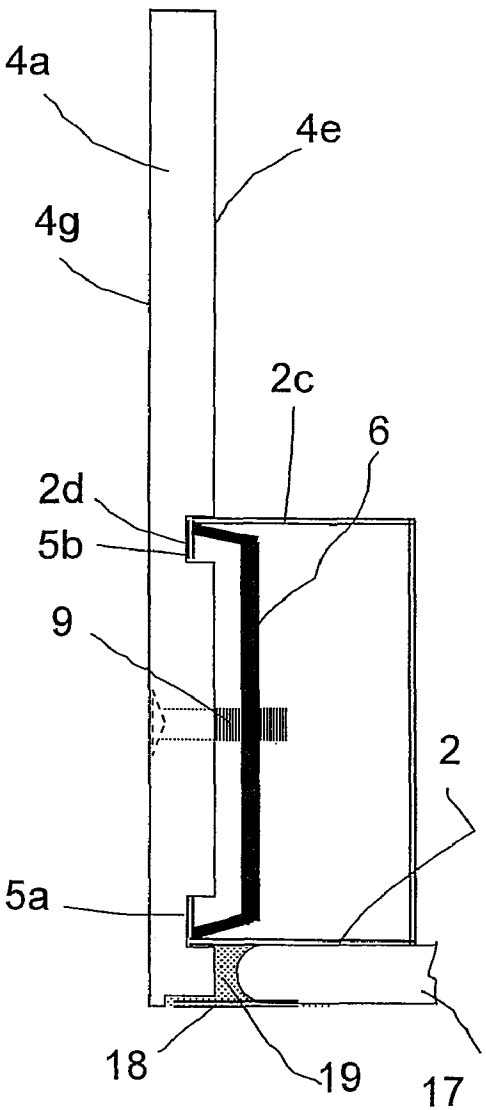
Fig. 5.3
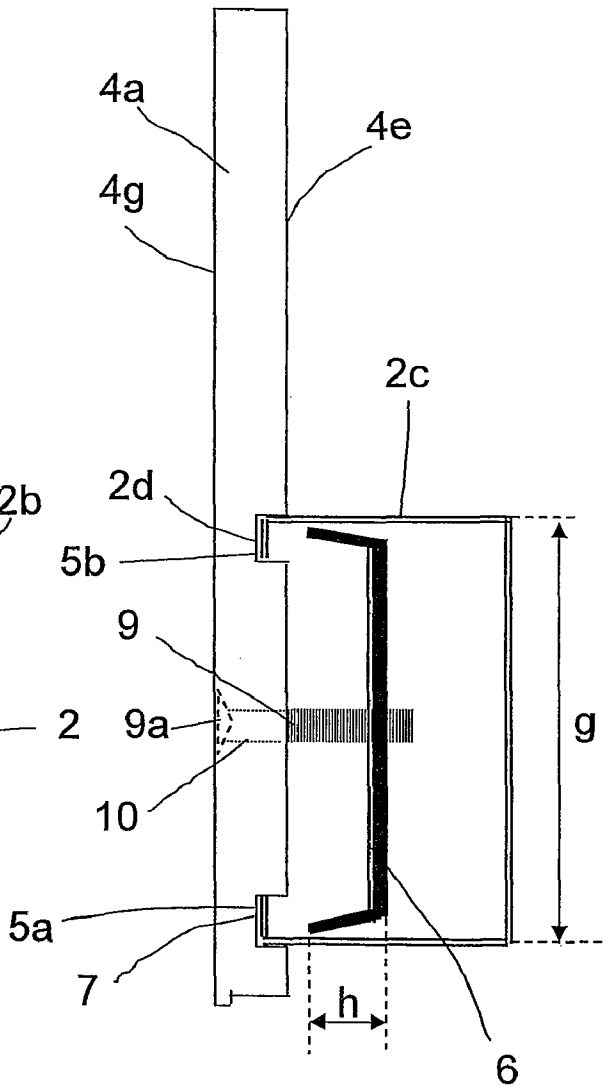
Fig. 5.2
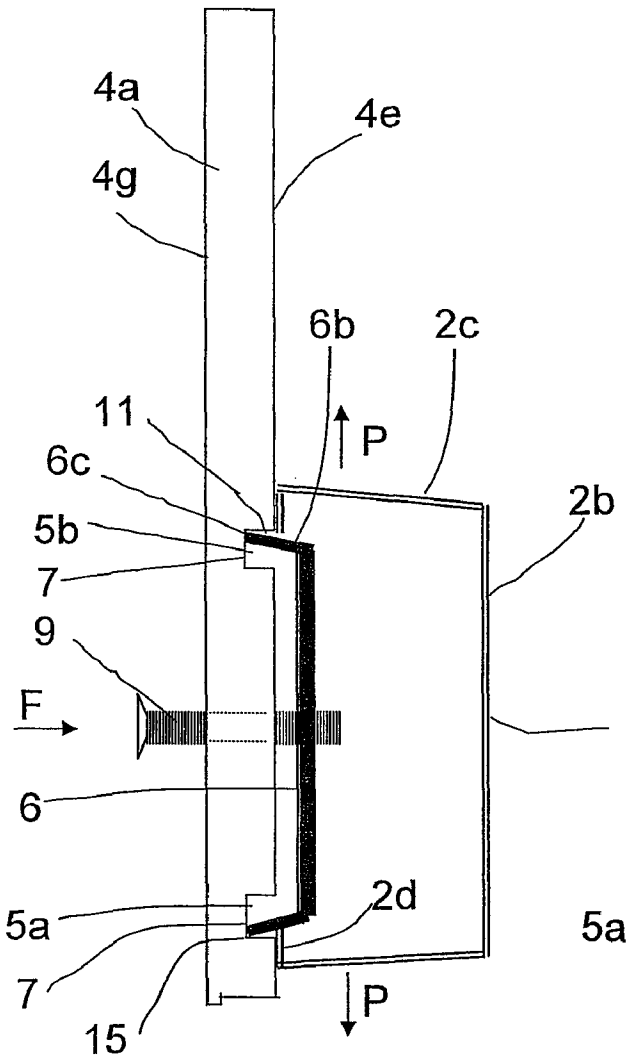
Fig. 5.1

DRYWALL CONSTRUCTION FOR SUPPORTING AN INSTALLATION ELEMENT AND METHOD FOR FASTENING THE INSTALLATION ELEMENT

BACKGROUND OF THE INVENTION

The invention pertains to an arrangement for storing objects with an installation element, such as a shelf, cupboard shell or cupboard, in a drywall construction, and, in particular, to drywall construction including a frame construction with vertical upright profiles, wherein the installation elements are fastened to the upright profiles. The invention also pertains to a method for fastening of installation elements in a drywall construction providing an arrangement, such as a cupboard shell, for keeping of objects, wherein the drywall construction has a frame construction with vertical upright profiles to which the installation elements are fastened. The vertical upright profiles may have a C-shaped cross section with legs.

Drywall constructions are generally known from the prior art. They consist of a frame construction, to which is fastened a dry construction board, especially gypsum plaster boards which may be screwed to the frame construction. The frame construction basically consists of vertical upright profiles, which are inserted at top and bottom into horizontal frame profiles and joined to them. The upright profile has a C-shaped cross section and the frame profile a U-shaped one. Such drywall constructions are used as walls, facing structures and paneling.

It is also generally known from the prior art how to install in such drywall construction installation elements, such as shelves, cupboard shells or cupboards in corresponding openings, in the drywall constructions, or how to use such lined openings as stowage space, in order to utilize the hollow space within the drywall constructions and possibly the hollow space between a drywall construction serving as paneling or facing wall and the rest of the wall, especially a load-bearing wall. In particular, hollow spaces at the roof and sills can also be lined. Such openings may be made individually in the drywall constructions from the same materials as the wall. For lack of a standard, such work is very time-intensive. In particular, the edges running around such openings have to be provided with an edge protection. As a rule, such individual openings are paneled with gypsum plaster boards and thus do not form a self-supporting structure. In particular, the edges around such openings have to be further provided with an edge protection. Furthermore, costly additional structures have to be affixed to the upright profiles in order to secure the gypsum plaster boards forming an alcove. Also, the same material as the wall does not afford any load-bearing surfaces for mounting of inlay floors or cupboard doors. Usually such individually fabricated alcoves lack a series of holes with a standard grid pattern for mounting of doors and false bottoms.

Furthermore, thus far, the installation elements, which may be made from wood or wooden materials, basically have to be individually adapted to the building circumstances, which is labor and cost intensive. Moreover, the mounting of an installation element while projecting drywall constructions is difficult, since usually the installation element has to be installed at a distance from the floor and it is heavy in weight, depending on its dimension. Furthermore, the standard upright profiles may be very unstable before being paneled on both sides. This drawback is especially significant when a facing wall is to be paneled on only one side and this one-sided paneling also has to be absent in the area of installation elements. The more installation elements, the less stable the construction.

Another problem lies in the making of a satisfactory seal for the front edges of the installation element with the drywall construction. The drywall constructions and their upright profiles are usually installed plumb. Accordingly, when mounting the installation elements, these need to be lined up with bubble levels and screwed firmly to the upright profiles. Each time the installation elements need to be oriented afterwards in a wall construction, it involves total removal of the screws and thus almost a complete dismantling. Even if only slightly re-oriented, the screw holes already present in the upright profiles are a disturbance, since the screws usually slip back into the existing holes. This is especially true for orienting in the millimeter range, which is essential for a projecting of the front edges from the wall surface in relation to the material thickness—for example, 12.5 mm for gypsum wallboard. A continual measuring and working with screw clamps or a helper may be required. This can only be accomplished with difficulty by a single installer and certainly only in several work steps. If several such installation elements are screwed one above the other and with a spacing from the smooth perpendicular side surfaces onto the smooth perpendicular closed side surfaces of upright profiles, an unstable situation results due to the slight material thickness of the profiles. The upright profiles and the installation elements, when installed separately from each other, each have their own installation tolerances, which in the most unfavorable case are opposite each other and thus need to be added together. The paneling surface of the wall boards mounted on them could thus end up afterwards in a position above and/or below the front edges. If the installation elements are screwed between the open side surfaces of two upright profiles, the tension force of the screws would first deform the web and then the flat bearing surface of the legs. Furthermore, the entrance of the screws into the thin steel plate of the web would be too far away from the head of a screw inside the installation element (around 70 mm, non-guided), so that the installation element would slump.

SUMMARY OF THE INVENTION

The basic problem solved by the present invention is to create an arrangement for the keeping of objects with installation elements in a drywall construction and a fastening method for fastening the installation element in a simple manner.

Moreover, the disclosed embodiments of the invention provide a solution wherein the installation element ensures a stiffening of the profiles at the installation site, even where one of the paneling sheets is absent.

Furthermore, the disclosed embodiments configure the front edges of the element so that they may be sealed with the wall surfaces by means of a reinforcement sheet so that this reinforcement is not damaged during a surface grinding process for the compound fixing the element.

A drywall construction arrangement including at least one installment element that is adapted to keep objects according to an aspect of the invention includes a frame construction with vertical upright profiles having a C-shaped cross section including legs. At least one installation element is fastened to the upright profile. The installation element defines an outer surface and includes a first groove and a second groove in the outer surface. The second groove is generally parallel to the first groove and is spaced away from the first groove. The legs of the upright profiles are inserted into the first groove and the second groove.

A method of fastening at least one installation element in a drywall construction, wherein the installation element is for the keeping of objects, according to an aspect of the invention, includes providing drywall construction having a frame construction with vertical upright profiles having a C-shaped cross section with legs to which the at least one installation element is fastened. A bracket-like holder element with leg pieces is fastened via a screw to a side wall of the at least one installation element, so that the two leg pieces come to bear against mating surfaces, each in a groove of the installation element. The holder element is pressed into an opening of the upright profile, so that the upright profile is widened with legs of the holder element coming to bear against the mating surface with webs extending from said legs. The holder element is pressed out from the grooves via the screw from inside the installation element in the direction of the upright element. The legs are moved into grooves by the webs. The screw is tightened from inside the installation element, which moves the holder element in the direction of the installation element and presses the webs against the mating surface of the side wall.

According to a more detailed embodiment of the invention, in an arrangement for the keeping of objects with installation elements in a drywall construction, with a frame construction with vertical upright profiles having a C-shaped cross section with legs, wherein the installation elements are fastened to the upright profiles, a simple mounting capability is achieved in that the installation elements have, on at least part of their outer surfaces, a first groove and a second groove parallel to this and spaced away from it, and in a fastening condition the legs of the upright profiles are inserted into the first groove and the second groove. The C-shaped upright profile is closed by the two grooves in the fastening condition and thus stiffened.

The installation elements may be fastened to the upright profiles by clamping with holders. The use of the holders simplifies the mounting and also enables a repeated mounting in almost identical position, since the clamping does not produce any permanent change in the upright profile, as compared to a screwing of the holding element in the upright profile, by the hole of the screw. If fastened once again in a similar position, the screw would again slip into the old borehole in the upright profile, nullifying the desired new positioning. The holders have the effect that the installation elements are secured to the upright profiles by a tensile force coming from the inner surfaces of the installation elements.

A further simplification of the installation may be achieved by the holders being configured such that, in an intermediate condition, the holders are held on the installation elements and can be slid along the upright profiles in order to orient the installation elements relative to the upright profiles. Thus, the holders can be fastened to the upright profile when the installation element is still on the floor. After this, the installation element can be pushed upward along the upright profiles and finally be secured in the desired position. This can easily be accomplished by a single person.

Also, an easy adjustment or even readjustment of the installation elements may be achieved in that the installation elements may be removably fastened by the holders to the upright profiles.

A clamping action may be achieved especially easily in that the upright profile with its C-shaped cross section may have two webs on legs that are opposite each other and bounding an opening. In the fastening condition, the holder engages with the webs.

One design is to have the holder in the form of a bracket with two leg pieces at a distance from each other. In the fastening condition, the leg pieces press the webs against the installation element.

A stable fastening may be achieved in that the grooves form mating surfaces with their bottom and have at least outer side surfaces, and, in the fastening condition, the holder presses the upright profile against the mating surface. This also presses the leg pieces of the upright profile against the outer side surfaces of the groove. The C-shaped upright profile is closed by the installation element in the fastening condition and thus stiffened. Neither does the holder change the external dimensions of the upright profile, so that the paneling can be done as usual with the drywall boards.

An easy fabrication of the drywall construction may be achieved in that the position of the installation element in relation to the upright profile is determined in respect of an installation depth by the holder, which bears against an outer side surface and/or inner side surface on the installation element. In this case, the upright profile is arranged with its front leg in the fastening condition at a distance from a front surface of the installation element, which basically corresponds to the thickness of a drywall board being fastened to the upright profile. A paneling of the frame construction with drywall boards thus results at once in a flush transition between the visible surface of a drywall board and the forwardmost part of the edges of an installation element. This idea may be used regardless of the holder.

An easy orienting of the installation element to the upright profile may be achieved in that the outer side surface and/or inner side surface runs parallel to a front surface of the installation element. Thus, the installation element takes on the orientation of the upright profiles.

A stable fastening of the holder to the installation element is made possible in that the outer side surfaces of the first groove and the second groove have a spacing which basically corresponds to the width of the upright profile, and the width of the grooves basically corresponds to the width of the webs of the upright profiles.

In one embodiment, the installation element is basically rectangular and consists of two side walls, a floor wall, a rear wall and a ceiling wall. The installation element may be fastened between two upright profiles via the holders in the drywall construction.

A further easing of the installation may be achieved in that the holder can be placed in the fastening condition by a screw and the screw can be tightened from inside the installation element.

A clean connection of the installation element to the dry wall board inside the drywall construction may be achieved in that the installation element has a front surface which contains a junction surface, in order to place a filler material between the installation element and a drywall board, and the junction surface recedes in the direction of the upright profile, relative to the front surface.

In an embodiment in which the junction surface is an inclined plane, which starts at one inner edge of the forward surface, a good adherence of the filler material may be achieved. The adherence may be further improved by arranging on the junction surface an element that increases the adherence for the filler material.

A method for fastening of installation elements in a drywall construction inside an arrangement for keeping of objects is disclosed wherein the drywall construction has a frame construction with vertical upright profiles having a C-shaped cross section with legs to which the installation elements are fastened. A simplified mounting may be achieved by the following steps:

i) fastening of a bracket-like holder element with leg pieces via a screw to a side wall of the installation element, so that the two leg pieces come to bear against mating surfaces, each in a groove of the installation element, ii) pressing of the holder element into an opening of the upright profile, so that the upright profile is widened with its legs and the leg comes to bear against the mating surface with its webs, iii) pushing of the holder element out from the grooves via the screw from inside the installation element in the direction of the upright element, iv) moving of the leg into grooves by its webs, and v) tightening of the screw from inside the installation element, which moves the holder element in the direction of the installation element and presses the webs against the mating surface of the side wall.

The above described arrangement is suitable as a facing wall, alcove paneling and partition wall, but it can also be constructed in the manner of a cupboard and thus not extend to the ceiling.

These and other objects, advantages and features of this invention will become apparent upon review of the following specification in conjunction with the drawings.

BRIEF DESCRIPTION OF THE DRAWINGS

The present invention is explained more closely hereafter by means of several sample embodiments presented in drawings.

FIGS. 5.1 to 5.3 are side elevation views of a side wall of an installation element and an upright profile in various phases of assembly.

DESCRIPTION OF THE PREFERRED EMBODIMENT

Figure 1:
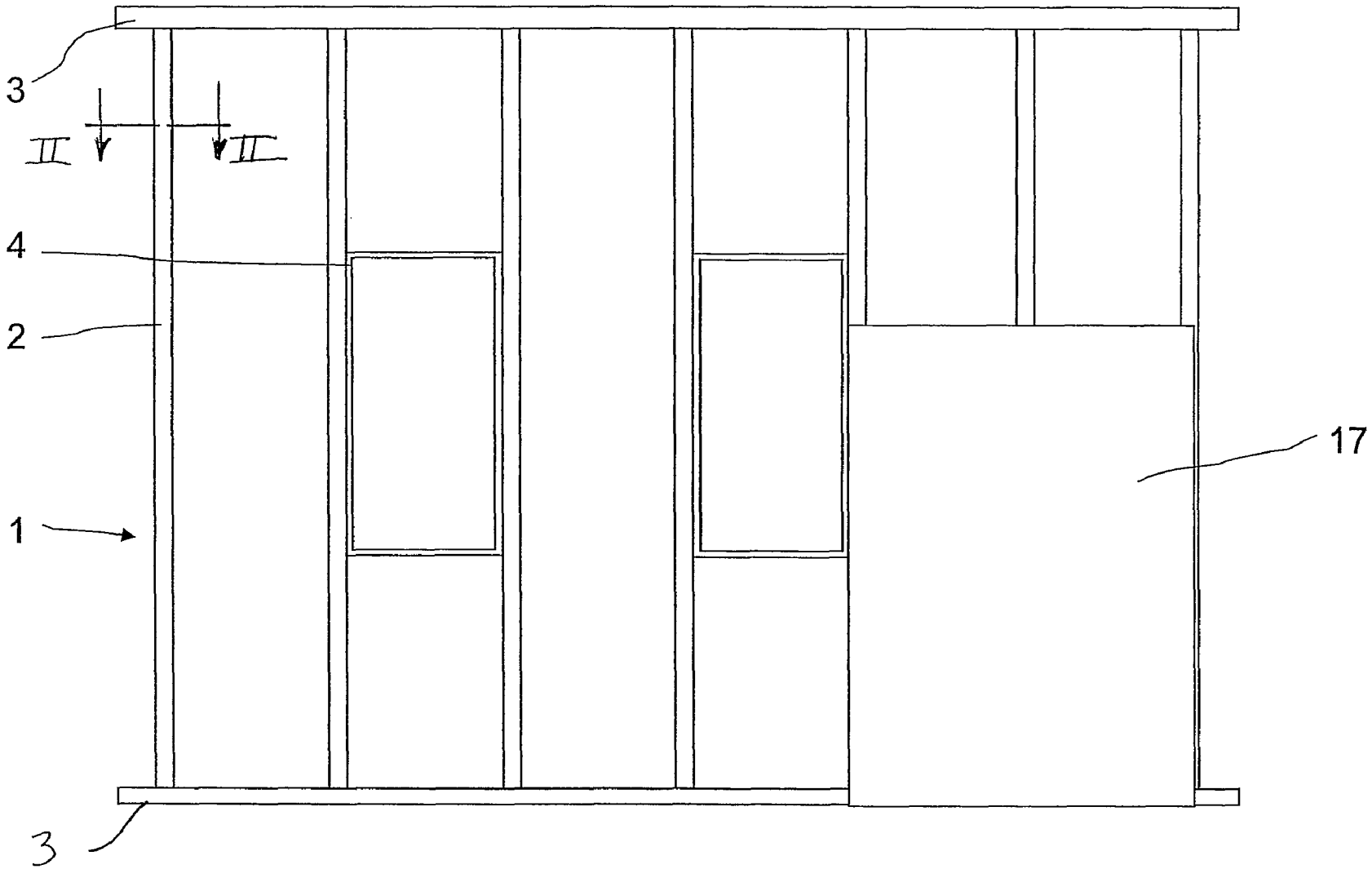
FIG. 1 is a side elevation of a frame construction of a gypsum plaster wall with installation elements mounted.

Referring now to the drawings and the illustrative embodiments depicted therein, a frame 1 of a drywall construction, especially a gypsum plaster wall, includes vertical upright profiles 2 that are inserted at their tops and bottoms into respective horizontal frame profiles 3 (FIG. 1). The vertical upright profiles can be joined to the profiles. In customary fashion, dry construction boards 17, especially gypsum plaster boards, may be screwed onto the upright profiles 2 and the frame profiles 3, in order to complete the drywall construction. The upright profile 2 has a C-shaped cross section and the frame profile 3 has a U-shaped one. The distance between neighboring upright profiles 2 may be adjusted to the width of the dry construction boards or other suitable boards, not shown. Between two upright profiles 2, an installation element 4 in the form of a cupboard shell is installed according to an embodiment of the invention. The dimensions of the installation elements 4 may be adapted to the particular application, but they can be adapted to the normal spacing between the upright profiles 2.

Figure 2:
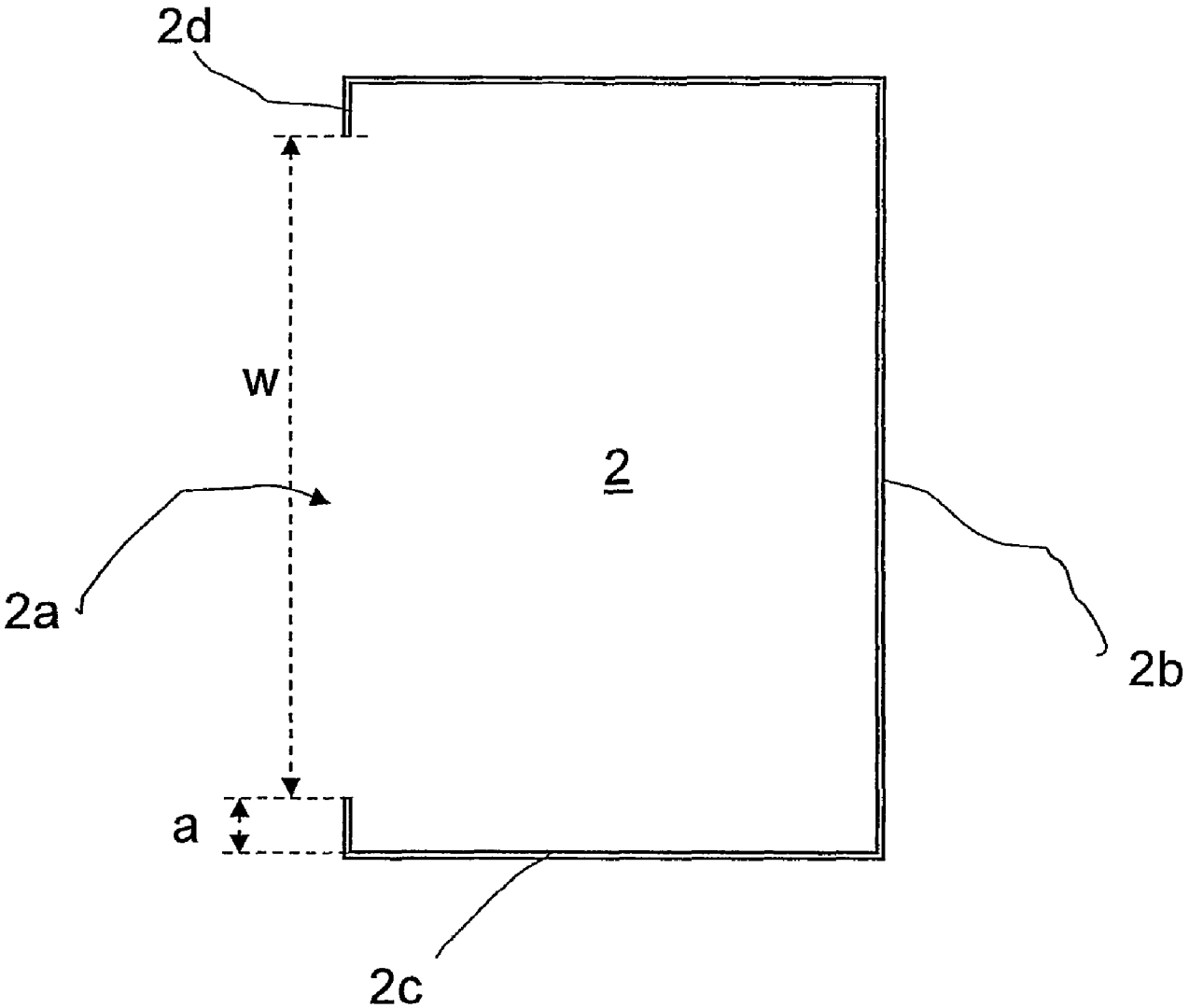
FIG. 2 is a sectional view taken along the lines II-II in FIG. 1.

FIG. 2 shows a cross section of the upright profile 2. The cross section clearly shows the C-shaped form of the standardized upright profile 2 with an opening 2*a*. The upright profile 2 has a flat profile base 2*b*, adjoined on each side by a leg 2*c* at right angles. In order to achieve the above-described C-shaped form, a web 2*d* is arranged at each end away from the base 2*b*, extending at right angles to the leg 2*c* and inwardly. Thus, the webs 2*d* extend in parallel with the base 2*b* and have a width a, starting from the legs 2*c*. The opening 2*a* remains between the facing ends of the webs 2*d* and its clear width is w.

Figure 3:
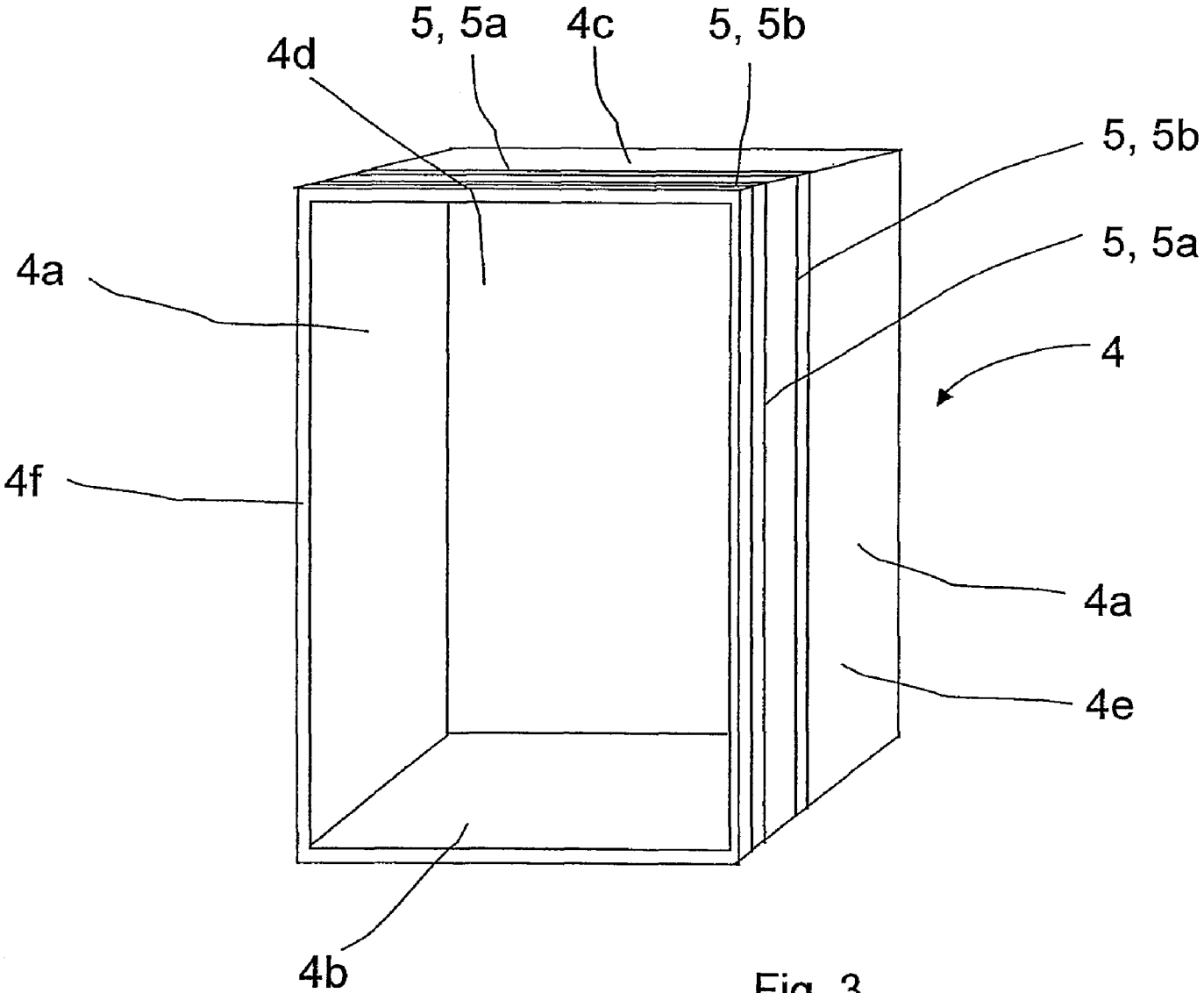
FIG. 3 is a perspective view of an installation element in the form of a cupboard shell.

FIG. 3 shows a perspective view of an installation element 4 in the form of a rectangular cupboard shell with two side walls 4*a* parallel to and situated at a distance from each other, being joined together at the bottom by a floor wall 4*b* and at the top by a ceiling wall 4*c*. Toward the back, the installation element 4 is closed by a rear wall 4*d*. Furthermore, as can be seen, a groove 5 is arranged on the outer surfaces 4*e* of the side walls 4*a*, the ceiling wall 4*c* and the floor wall 4*b*. The groove 5 in the present sample embodiment is divided into a first front groove 5*a* and a second rear groove 5*b*, which run parallel to and at a distance from each other. Moreover, the first groove 5*a* and a second groove 5*b* are oriented parallel to the front surface 4*f* of the side wall 4*a*, and the ceiling wall 4*c* and the floor wall 4*b*. Since these grooves 5, 5*a*, 5*b* are also provided in the ceiling wall 4*c* and the flow wall 4*b*, the grooves 5, 5*a*, 5*b* then run around the outer sides 4*e* of the installation element 4. It is also possible to arrange the grooves 5, 5*a*, 5*b* only in the side walls 4*a*, since, in many installation cases, one can achieve a sufficient fastening of the installation element 4 to the upright profiles 2 in this way. Furthermore, the fastening of the installation element 4 in the frame construction 1 is additionally strengthened in that the frame construction 1 in a later work step is lined with dry construction boards 17 and thus the installation element 4 may additionally be tied into the wall.

The installation element 4 may be made from wooden materials and/or similar materials, such as from plywood or other wooden materials that experiences little contraction. Installation element 4 may have a series of holes in the standard pattern of furniture construction. Such an installation element 4 can be closed with customary doors (not shown) made of wood, metal or glass, as well as combinations of these, to form a cupboard. Inlay floors of suitable materials can also be provided. Furthermore, the installation element 4 can also be used as a stowage space in the form of an alcove created in this way, with no additional installed pieces.

Figure 4:
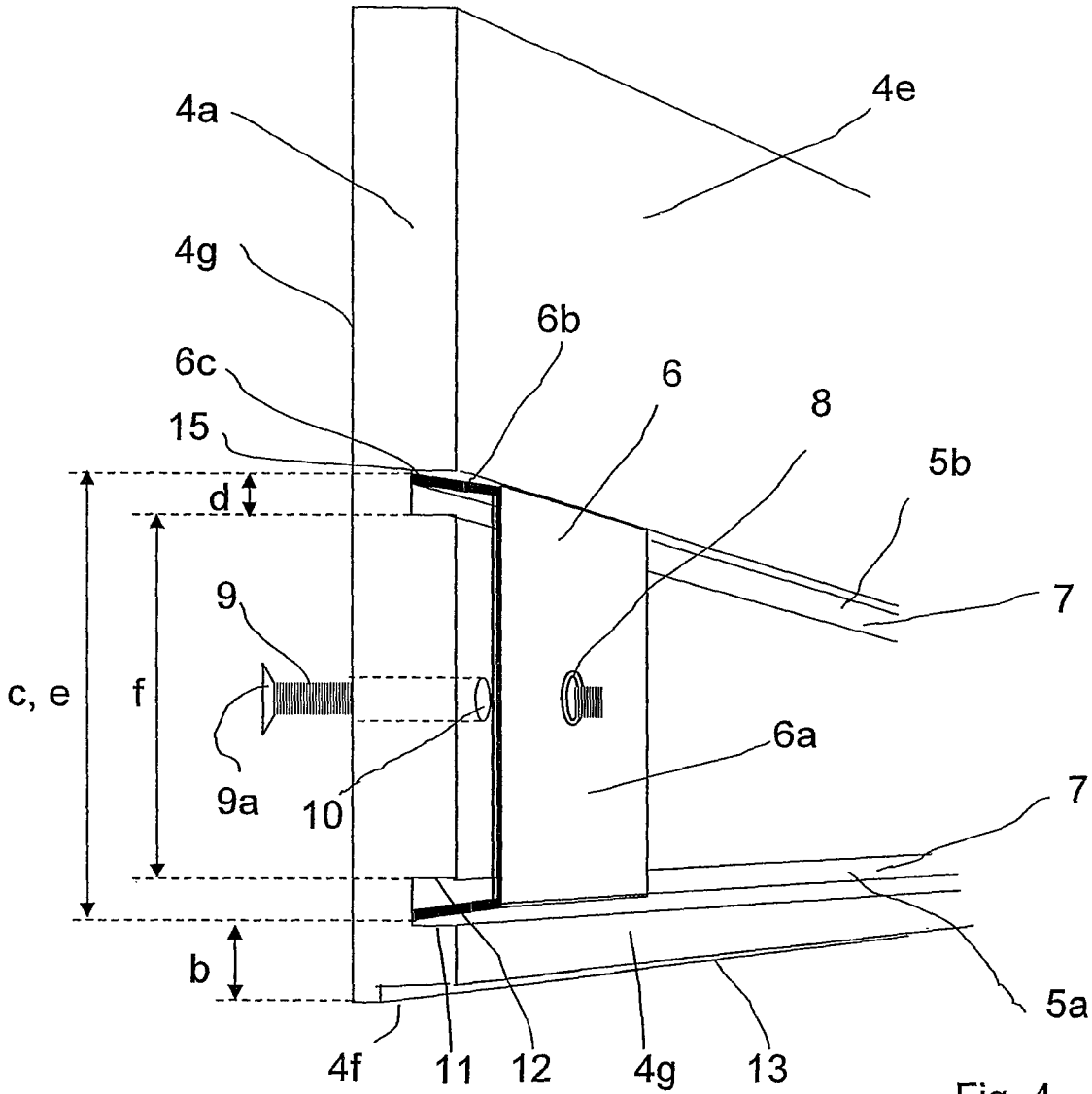
FIG. 4 is a perspective view of a side wall of an installation element illustrated in FIG. 3.

FIG. 4 shows a perspective view of a side wall 4*a* of an installation element 4. Besides the side wall 4*a* with the first groove 5*a* and the second groove 5*b*, a bracket-like holder 6 is also shown, with which the installation element 4 is fastened onto the upright profiles 2 (not shown in FIG. 4). The holder 6 is configured as a U-shape in cross section with a base piece 6*a* and two leg pieces 6*b* joined to this at the sides. The angle subtended by the base piece 6*a* and the leg pieces 6*b* is illustrated as a right angle or one in the range between approximately 90 degrees and approximately 120 degrees, preferably around 110 degrees. In the installed condition, the holder 6 rests with its ends of the leg pieces 6*b* away from the base piece 6*a* against a mating surface 7, formed by the bottom of the grooves 5*a*, 5*b*.

Furthermore, FIG. 4 shows that a threaded borehole 8 may be arranged centrally in the base piece 6*a* of the holder 6, in which a screw 9 with corresponding thread is held. This screw 9 starting from the holder 6 is led through a borehole 10 in the side wall 4*a* and can thus be tightened from the inner surface 4*g* of the installation element 4. The borehole 10 is arranged centrally between the first groove 5*a* and the second groove 5*b*. In the tightened condition, the head 9*a* of the screw 9 thrusts against the inner side 4*g* of the side wall 4*a* and the screw 9 by its thread thrusts against the holder 6, which rests by its legs 6*b* against the mating surfaces 7. Furthermore, in the tightened condition of the screw 9, the leg pieces 6*b* of the holder 6 are forced with their outer end regions 6*c* in the direction of the first groove 5*a* and the second groove 5*b*. The outer side surface 11 adjoins the mating surface 7 at a right angle, and they intersect at a corner 15.

In regard to the dimensioning and the arrangement of the first groove 5*a* and the second groove 5*b*, as illustrated in FIG. 4, grooves 5*a*, 5*b* looking in their lengthwise direction have a width d in the region of their mating surfaces 7—the actual bottom of the groove. The width d corresponds roughly to the width a of the webs 2*d* of the upright profiles 2. Moreover, the first and second grooves 5*a*, 5*b* have a rectangular cross section. Furthermore, the width of the holder 6 corresponds to the spacing e of the ends of the outer terminal regions 6*c* of the leg pieces 6*b* of the holder 6. Also, the first groove 5*a* and the second groove 5*b* each have an inner side surface 12 whose spacing f from each other roughly corresponds to the clear width w of the opening 2*a* of the upright profile 2. The spacing e of the ends of the outer terminal regions 6*c* of the leg pieces 6*b* of the holder 6 roughly coincides with the spacing e between the two outer side surfaces 12 of the grooves 5*a* and 5*b*. FIG. 4 shows another important dimension, namely, the spacing b between the front surface 4*f* of the side wall 4*a* and the outer side surface 11 of the first groove 5*a*. The spacing b corresponds to the thickness dimension of the dry construction boards 17 for the lining of the frame construction 1. In this way, the dry construction boards 17 fastened to the upright profiles 2 and the frame profiles 3 are flush with the front surfaces 4*f* of the side wall 4*a*.

In connection with the flush sealing of the dry construction boards 17 with the front surfaces 4*f* of the side wall 4*a*, FIG. 4 illustrates that the side wall 4*a* has a bearing surface 4*g* facing the dry construction boards 17. This bearing surface 4*g* is connected to the front surface 4*f* by an adjoining junction surface 13. The junction surface 13 serves to provide a greater adhesive surface for a filler material 19 and a reinforcement band 18, which is used to fill the gap created between the dry construction board 17 and the side wall 4*a* (see also FIG. 5.3). Within the junction surface 13, recesses (not shown) in the form of notches can be provided to improve the adhesion between the filler material 19 and the side wall 4*a* by an intermeshing effect. Different materials, such as gypsum plaster board and wooden materials, have different lengthwise shrinkage. A reinforcement sheet 18 may be provided to prevent cracks from forming in the filler surface. A broad strip will then continue to stand out from the front surface 4*f*. As illustrated in FIG. 4, the junction surface 13 may be oriented parallel to the front surface 4*f*. In order to create space for the filler material 19, this junction surface 13 is set back to the rear from the front surface 4*f*. Thus, installed reinforcement band 18 lies below the front surface 4*f* within the filler material 19. During a grinding step, the front surface 4*f* protects the reinforcement sheet 18 from being disturbed. The junction surface 13 can also be configured as a surface slanting from the front surface 4*f* and decreasing toward the gap. In a preferred embodiment, this junction surface 13 then runs as far as a front surface 4*f* reduced to one edge. It is also possible to provide a reinforcement 18 in addition to the junction surface 13, in order to further increase the stability of the filler material 19 (see FIG. 5.3).

FIGS. 5.1 to 5.3 show perspective views of a side wall 4*a* of an installation element 4 and an upright profile 2 in various phases of assembly. The first assembly step is shown in FIG. 5.1. The holder 6 rests by its outer end regions 6*c* of the two leg pieces 6*b* via the legs 2*c* and webs 2*d* of the upright profile 2 against the mating surfaces 7 in the grooves 5*a* and 5*b*. The outer end regions 6*c* also lie against the outer side surfaces 11 of the grooves 5*a* and 5*b* via the legs 2*c* and webs 2*d* of the upright profile 2. Since the grooves 5*a* and 5*b* have a rectangular cross section, the mating surface 7 and the outer side surfaces 11 intersect in a corner 15, in which region the outer end regions 6*c* of the two leg pieces 6*b* also rest accordingly. The holder 6 is maintained in this position by the screw 9, which is screwed by a few turns of the thread into the threaded borehole 8 of the holder 6 when it is resting in the grooves 5*a* and 5*b*. Since the diameter of the borehole 10 in the side piece 4*a* is slightly smaller than the outer diameter of the thread of the screw 9, the screw 9 is also held in the borehole 10 and so is the holder 6 held in the starting position per FIG. 5.1. In the starting position, the holder 6 protrudes from the grooves 5*a* and 5*b* and thus projects as a whole out from the side wall 4*a*.

As shown in FIG. 5.1, installation element 4 is being installed in a prepared frame construction 1 with its holders 6 as described above. Usually, for this step, the installation element 4 is set on the floor and slid in the direction of an already installed vertical upright profile 2. FIG. 5.1 shows an upright profile 2 of the frame construction 1, into whose opening 2*a* a holder 6 has been pushed, joined to a left side wall 4*a*, until the outer surface 4*e* of the left side wall 4*a* comes to bear against the webs 2*d* of the upright profile 2. Depending on the size of the installation element 4 and the length of the side wall 4*a*, several holders 6 may be arranged at a distance from each other along the grooves 5*a* and 5*b*, and all of them are then pressed into the upright profile 2 as described above. In this way, the upright profile 2 widens out, with its legs 2*c* moving outward in direction P. In this starting position, the holder 6 blocks the grooves 5*a* and 5*b*.

FIG. 5.2 shows the next assembly step. For this, the screws 9 of the holders 6 are threaded far enough in direction F into the borehole 10 of the side wall 4*a*, for example, simply by using the thumb, until the head 9*a* of the screw 9 comes to bear against the inner surface 4*g* of the side wall 4*a*. In this way, the holder 6 leaves the grooves 5*a* and 5*b*, the upright profile 2 again assumes its original rectangular shape, and the legs 2*c* slip into the grooves 5*a* and 5*b* with their webs 2*d*.

In the final assembly step per FIG. 5.3, screws 9 are tightened from the inner surface 4*g* of the side wall 4*a*, so that the holder 6 moves in the direction of the two grooves 5*a* and 5*b*, lying there against the webs 2*d* from the inside and forcing the webs 2*d* and the legs 2*c* into the groove 5*a* or 5*b*. Thus, the side wall 4*a* is securely held by the holder 6 against the upright profile 2, which is further stabilized by the holder 6 and the side piece 4*a*, closing the otherwise open cross section. It is advantageous to at first only slightly tighten the screws 9, so that the installation elements 4 can only just be shoved along the upright profiles 2 for an orienting. Once oriented in this manner, the screws 9 are then tightened.

Once the left side piece 4*a* has been secured to the upright profile 2, the next upright profile 2 is inserted into the frame construction 1 and connected to the right side piece 4*a* of the installation element 4. Then, additional installation elements 4 are assembled as needed. Once this is complete, the frame construction 1 is then made ready and in a last work step the frame construction 1 is closed up with dry construction boards 17, each of them being flush with the front surfaces 4*f* of the side walls 4*a*.

Furthermore, as can be seen in FIG. 5.3, a reinforcement sheet 18 is provided in the edge region of the dry construction board 17 and the junction surface 13 into the vicinity of the front surface 4*f* reduced at the edge, being embedded in the filler material 19.

The ceiling wall 4*c* and/or the floor wall 4*b* can also be fastened in the frame construction 1 by their grooves 5*a*, 5*b* and corresponding holders 6 to other horizontal profiles (not shown) of the frame construction 1.

In addition, another pair of grooves 5*a*, 5*b* can be arranged in the side wall 4*a* at the opposite sides of the side wall 4*a*, whose outer groove has a distance b from the front edge 4*f* that is twice the thickness of a dry construction board 17. In this way, a flush double lining can be achieved when the installation element 4 is turned by 180 degrees. Depending on the depth of the side wall 4*a*, a total of three grooves can then be enough, with the middle groove used in both the single-side and the double-side lining.

If the installation element 4 should have a greater depth, several grooves 5 or pairs of grooves 5*a*, 5*b* can also be provided at the side walls 4*a*. Accordingly, additional upright profiles 2 will also be provided.

Figure 6:
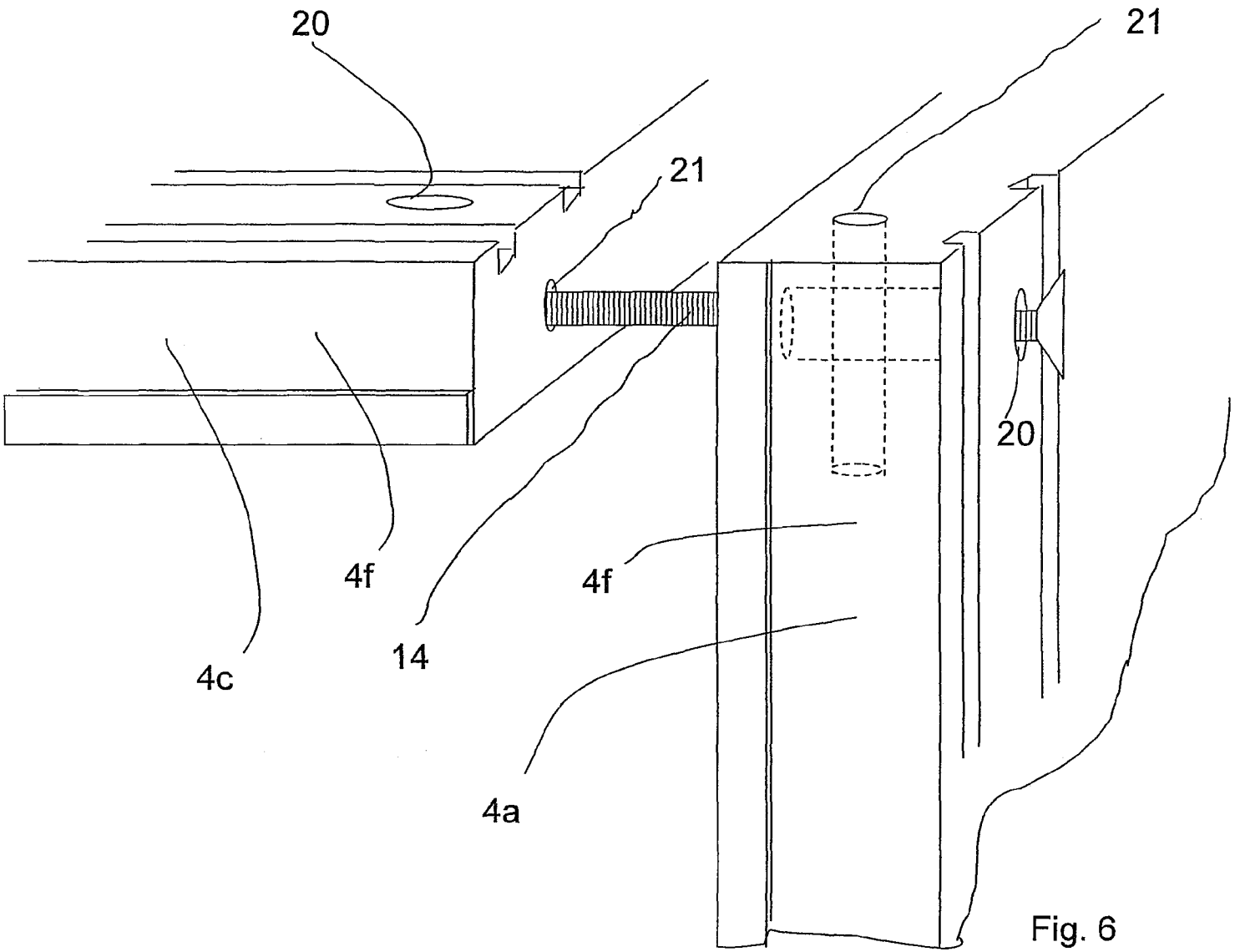
FIG. 6 is a perspective view of a corner region of a cupboard shell being assembled.

FIG. 6 shows a perspective view of a corner region of an installation element 4 being assembled in the form of a cupboard shell. As can be seen, boreholes 21 are arranged in the side walls 4*a*, the ceiling wall 4*c* and the floor wall 4*b*, being oriented accordingly in the lengthwise direction of the walls 4*a*, 4*b* and 4*c* and parallel to their front surfaces 4*f*, intersecting in the middle with boreholes 20 running transversely to them. The side walls 4*a* are fastened by screws 14 inserted through the boreholes 20 in the side walls 4*a* to the end faces of the ceiling wall 4*c* or floor wall 4*b* in the borehole 21 arranged there. The borehole 21 has a smaller diameter than the borehole 20, to offer purchase to the screw 14.

In the illustrated embodiment, the upright profiles are configured preferably as standardized C-shaped profiles and the horizontal frame profiles 3 preferably as standardized U-shaped profiles. It is also entirely possible to use wooden profiles with corresponding cross sections, with the wall thicknesses of the profiles being dimensioned according to the properties of the wood.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A drywall construction arrangement including at least one installation element that is adapted to keep objects, said drywall construction comprising:

a frame construction with vertical upright profiles having a C-shaped cross section including legs;

at least one installation element fastened to the upright profile wherein said at least one installation element defines an outer surface and includes a first groove and a second groove in said outer surface, said second groove parallel to said first groove and spaced away from said first groove;

wherein the legs of the upright profiles are inserted into the first groove and the second groove;

a plurality of holders that is adapted to clamp the installation elements to the upright profiles;

wherein said holders are configured such that, in an intermediate state, the holders are supported by the installation elements and are adapted to be slid along the upright profiles in order to orient the installation elements relative to the upright profiles;

wherein said at least one installation element is removably fastened by the holders to the upright profiles;

wherein said legs define a pair of webs extending opposite each other and bounding an opening, and wherein the holders engage with the webs in a fastened state; and wherein said holders are in the form of a bracket with two leg pieces at a distance from each other, and wherein said leg pieces press the webs against the installation element in the fastened state.

2. The drywall construction arrangement of claim 1, wherein said grooves form mating surfaces with their bottom and have at least outer side surfaces, and wherein the holders press the upright profile against the mating surface in the fastened state.

3. The drywall construction arrangement of claim 2, wherein a position of the installation element in relation to the upright profile is determined in respect of an installation depth by the holders, which bears against a side surface on the installation element.

4. The drywall construction arrangement of claim 3, wherein the legs of the upright profile are at a particular distance from a front surface of the installation element when in the fastened state, the particular distance corresponding to the thickness of a drywall board being fastened to the upright profile.

5. The drywall construction arrangement of claim 4, wherein the side surfaces run parallel to the front surface of the installation element.

6. The drywall construction arrangement of claim 5, wherein the side surfaces of the first groove and the second groove have a spacing which corresponds to a width of the upright profile, and the width of the grooves corresponds to a width of the webs of the upright profiles.

7. The drywall construction arrangement of claim 1, wherein said at least one installation element is fastened between two upright profiles via the holders.

8. The drywall construction arrangement of claim 1, wherein said at least one installation element is generally rectangular in shape and includes two side walls, a floor wall, a rear wall and a ceiling wall.

9. The drywall construction arrangement of claim 8, wherein said holders can be placed in the fastening condition by a screw and the screw can be tightened from inside the installation element.

10. The drywall construction arrangement of claim 8, wherein said installation element has a front surface which contains a junction surface, in order to place a filler material between the installation element and a drywall board, and the junction surface recedes in the direction of an upright profile, relative to the front surface.

11. The drywall construction arrangement of claim 1, wherein the legs of the upright profile are at a particular distance from a front surface of the installation element when in the fastened state, the particular distance corresponding to the thickness of a drywall board being fastened to the upright profile.

12. The drywall construction arrangement of claim 11, wherein side surfaces of said grooves run parallel to the front surface of the installation element.

13. The drywall construction arrangement of claim 12, wherein the side surfaces of the first groove and the second groove have a spacing which corresponds to a width of the upright profile and the width of the grooves corresponds to a width of the webs of the upright profiles.

14. The drywall construction arrangement of claim 1, wherein said holders can be placed in the fastening condition by a screw and the screw can be tightened from inside the installation element.

* * * * *